US011425960B2

(12) United States Patent
Frey

(10) Patent No.: US 11,425,960 B2
(45) Date of Patent: Aug. 30, 2022

(54) SPORTS BOOT

(75) Inventor: Nicolas Frey, Lausanne (CH)

(73) Assignee: NB NEWBOOTS SA, Geneva (CH)

( * ) Notice: Subject to any disclaimer, the term of this patent is extended or adjusted under 35 U.S.C. 154(b) by 477 days.

(21) Appl. No.: 14/241,526

(22) PCT Filed: Sep. 13, 2012

(86) PCT No.: PCT/EP2012/068015

§ 371 (c)(1),
(2), (4) Date: Apr. 18, 2014

(87) PCT Pub. No.: WO2013/037924

PCT Pub. Date: Mar. 21, 2013

(65) Prior Publication Data

US 2014/0215855 A1 Aug. 7, 2014

(30) Foreign Application Priority Data

Sep. 15, 2011 (CH) ..... 20110001523

(51) Int. Cl.
*A43B 5/04* (2006.01)
*A43B 13/22* (2006.01)

(52) U.S. Cl.
CPC ..... *A43B 5/0478* (2013.01); *A43B 5/0405* (2013.01); *A43B 5/048* (2013.01); *A43B 5/0409* (2013.01); *A43B 13/226* (2013.01)

(58) Field of Classification Search
CPC ..... A43B 5/04; A43B 5/0401; A43B 5/0409; A43B 5/0439; A43B 5/0443; A43B 5/0476; A43B 5/0478; A43B 5/048
USPC ..... 36/117.1, 118.2, 117.7, 118.9
See application file for complete search history.

(56) References Cited

U.S. PATENT DOCUMENTS 3,645,017 A * 2/1972 Hickmann ..... A43B 5/0427 36/117.4
3,750,310 A 8/1973 Messner et al.
4,019,267 A * 4/1977 Sadler ..... A43B 5/04 36/118.2
4,179,827 A * 12/1979 Vaccari ..... A43B 5/0439 36/117.8

(Continued)

FOREIGN PATENT DOCUMENTS

DE 102004014807 B3 9/2005
EP 232488 A2 * 8/1987 ..... A43B 5/04

(Continued)

OTHER PUBLICATIONS

Appendix "A".*
International Search Report for PCT/EP2012/068015 dated Jan. 25, 2013.

*Primary Examiner* — Megan E Lynch
(74) *Attorney, Agent, or Firm* — Pearne & Gordon LLP

(57) ABSTRACT

Sports boot comprising: an inner boot (3); an exogenous shell (1), the dimensions of which allow said inner boot (3) to be inserted into or extracted from it, said exogenous shell strengthening said inner boot and allowing it to be attached to a piece of sports equipment; wherein said exogenous shell comprises a sole (10), a forward part of an upper (11) able to pivot with respect to said sole (10) about a first articulation (110), and a rear part of an upper (12) which is able to pivot with respect to said sole (10) about a second articulation (120).

23 Claims, 7 Drawing Sheets

(56) References Cited

U.S. PATENT DOCUMENTS 4,280,286 A * 7/1981 Sartor ..... A43B 5/0427 36/105
4,317,294 A * 3/1982 Goodyear ..... A43B 13/36 36/100
4,542,599 A * 9/1985 Annovi ..... A43B 5/0419 36/117.4
4,551,933 A * 11/1985 Morell ..... A43B 5/0429 36/118.2
4,565,017 A * 1/1986 Ottieri ..... A43B 1/0018 36/117.8
4,685,226 A * 8/1987 Olivieri ..... A43B 5/0427 36/105
4,813,668 A * 3/1989 Solloway ..... A63B 21/0084 36/105
4,823,484 A * 4/1989 Couty ..... A43C 11/008 24/68 SK
4,905,384 A * 3/1990 De Marchi ..... A43C 11/004 36/118.9
4,914,839 A * 4/1990 Paris ..... A43B 5/0445 36/117.7
4,922,633 A * 5/1990 Sartor ..... A43B 5/048 36/117.8
5,079,859 A * 1/1992 De Bortoli ..... A43B 5/0474 36/118.9
5,167,083 A * 12/1992 Walkhoff ..... A43B 5/0449 36/118.2
5,177,885 A * 1/1993 Marmonnier ..... A43B 5/04 36/118.9
5,203,098 A * 4/1993 Perrissoud ..... A43B 5/0478 36/118.7
5,279,053 A * 1/1994 Pallatin ..... A43B 5/0409 36/10
5,295,316 A * 3/1994 Bergamin ..... A43B 5/04 36/117.8
5,329,707 A * 7/1994 Chaigne ..... A43B 5/048 36/118.2
5,363,571 A * 11/1994 Montfort ..... A43B 5/0447 36/117.7
5,425,187 A * 6/1995 Artusi ..... A43B 5/0433 36/117.1
5,526,587 A * 6/1996 Sartor ..... A43B 5/0405 36/10
5,557,866 A * 9/1996 Prengler ..... A43B 5/00 36/138
5,740,620 A * 4/1998 Giese ..... A43B 5/04 36/115
5,775,009 A * 7/1998 Marega ..... A43B 5/1641 36/117.5
5,826,354 A * 10/1998 Garbujo ..... A43B 11/00 36/117.1
5,971,423 A * 10/1999 Hansen ..... A43B 5/0401 280/634
6,098,317 A * 8/2000 Lazzaroni ..... A43B 5/0411 36/101
7,377,058 B2 5/2008 Elkington et al.
2004/0074110 A1* 4/2004 Borsoi ..... A43B 5/0405 36/50.5
2004/0221486 A1* 11/2004 Dennison ..... A43B 7/18 36/31
2004/0250452 A1* 12/2004 Farys ..... A43B 5/002 36/89
2005/0204585 A1* 9/2005 Loveridge ..... A43B 1/0018 36/54
2005/0210711 A1* 9/2005 Galeyev ..... A43B 5/04 36/118.2
2006/0086006 A1 4/2006 Forrest
2006/0196083 A1* 9/2006 Martin ..... A43B 5/0401 36/50.5
2011/0067271 A1* 3/2011 Foxen ..... A43B 3/0047 36/131

FOREIGN PATENT DOCUMENTS

EP 252417 A2 * 1/1988 ..... A43B 5/04
EP 0486801 A1 * 5/1992 ..... A43B 4/04
EP 0841017 A2 5/1998
FR 2136161 A5 12/1972
FR 2570936 A1 * 4/1986 ..... A43B 5/0466
FR 2800976 A1 * 5/2001 ..... A43B 5/04
WO 2009097550 A1 9/2009

* cited by examiner

SPORTS BOOT

FIELD OF THE INVENTION

The present invention relates to the field of sports boots, notably the field of sports boots comprising a rigid shell for skiing, skating etc. The present invention relates in particular to a sports boot with a rigid exogenous shell and a removable inner boot of the touring type.

STATE OF THE ART

Ski boots comprising an inner boot and a rigid exogenous shell are known in the state of the art. The inner boot can be extracted from the exogenous shell for walking more comfortably, or inserted into this shell for skiing. An example of such a boot is described in WO2009/097550.

BRIEF SUMMARY OF THE INVENTION

One of the problems with ski boots with an exogenous shell is the transmission of the forces between the inner boot and the exogenous shell. In fact, the inner boot is generally not fastened to the exogenous shell but can slide or move inside it, which prevents an efficient transmission of forces and compromises the skiing style.

One aim of the present invention is to propose a new sports boot with an improved exogenous shell.

According to the invention, these aims are achieved notably by means of a sports boot comprising:

- an inner boot (3);
- an exogenous shell (1), whose dimensions allow said inner boot (3) to be inserted into or extracted from it, said exogenous shell strengthening said inner boot and allowing it to be attached to a piece of sports equipment;
- said exogenous shell comprising a sole (10) and an upper;
- said inner boot comprising a pivot protruding on the outer side close to the ankle,
- said exogenous shell comprising a housing for accommodating the pivot.

This solution makes it notably possible to integrally unite the inner boot and the exogenous shell at an important point for the transmission of forces notably during ski turns.

The exogenous shell can comprise a forward part of an upper capable of pivoting with respect to the sole around a first articulation and/or a rear part of an upper capable of pivoting with respect to said sole around a second articulation. The inner boot can be inserted into the exogenous shell respectively extracted from the exogenous shell by pivoting the rear part of the upper. Buckles can be provided for holding the forward part of the upper and the rear part of the upper closed and tight one against the other. This construction enables the inner boot to be easily extracted resp. inserted and this inner boot to be held efficiently at the ankle.

The housing for the pivot can be opened respectively closed by pivoting the forward part of the upper and/or the rear part of the upper. One portion of the housing's circumference can be formed by an indentation on the forward part of the upper, and another portion of this housing's circumference can be formed by an indentation on the rear part of the upper. The protruding pivot on the inner boot can comprise an annular groove for accommodating the indentations. This construction enables a rigid connection between the pivot and the housing and an easy uncoupling of these components by simply opening the forward or rear part of the upper.

The boot can include a reinforcement around the Achilles tendon that is articulated relative to the sole of the exogenous shell and can be fastened to the rear upper.

According to an independent characteristic of the presence of a pivot and of a housing, the sole of the exogenous shell can comprise holes for evacuating water inside this shell. Advantageously, the exogenous shell comprises a structure that is to a large extent perforated to allow the inner boot to be seen and water to be evacuated.

The inner side of this sole can include a relief pattern, for example ribs and grooves, working together with a corresponding pattern under the sole of the inner boot, so as to position laterally and to the required height the inner boot in the exogenous shell. This construction thus affords another rigid fastening point (at least along the axis perpendicular to the foot) between the inner boot and the exogenous shell.

The invention also relates to an exogenous shell as described and to an inner boot on its own as described.

BRIEF DESCRIPTION OF THE FIGURES

Examples of embodiments of the invention are indicated in the description illustrated by the attached figures, in which.

EXAMPLE(S) OF EMBODIMENTS OF THE INVENTION

The illustrated sports boot is a ski boot. The invention could also apply to other types of sports boots, for example skating boots, snowboard boots etc.

Figure 1:
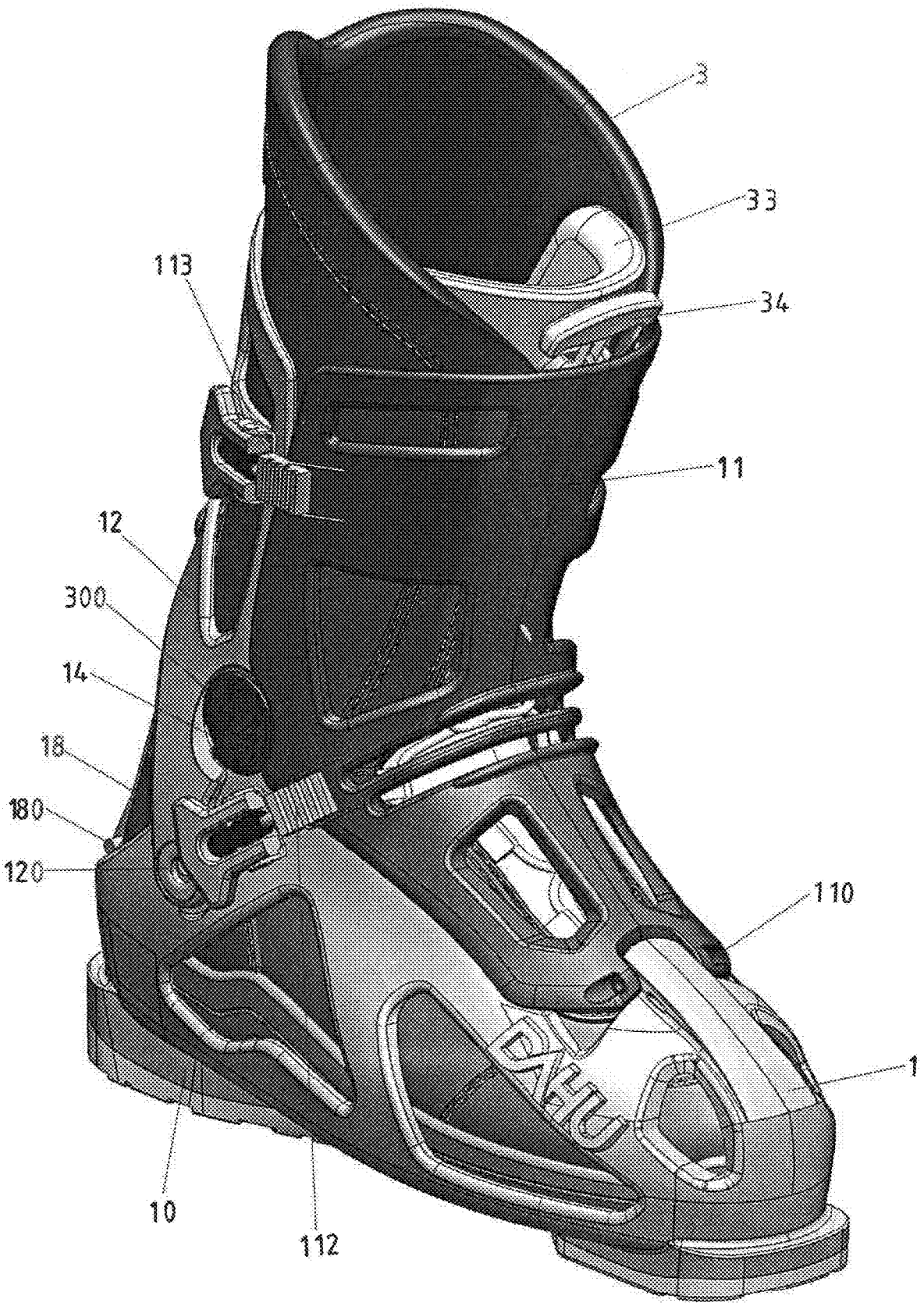
FIG. 1 illustrates a complete ski boot with the inner boot and the closed exogenous shell.
Figure 2:
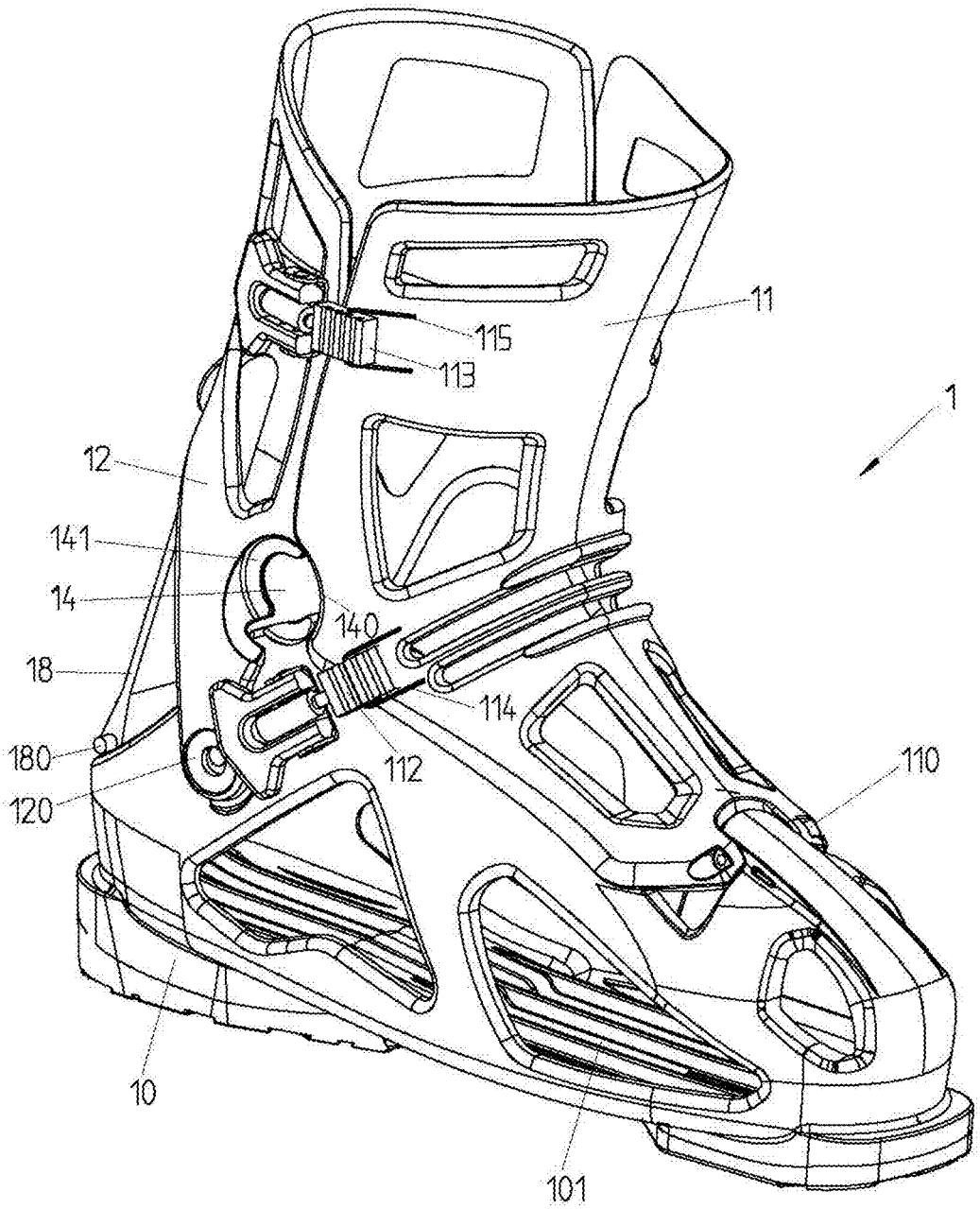
FIG. 2 illustrates an exogenous shell on its own in closed position.
Figure 3:
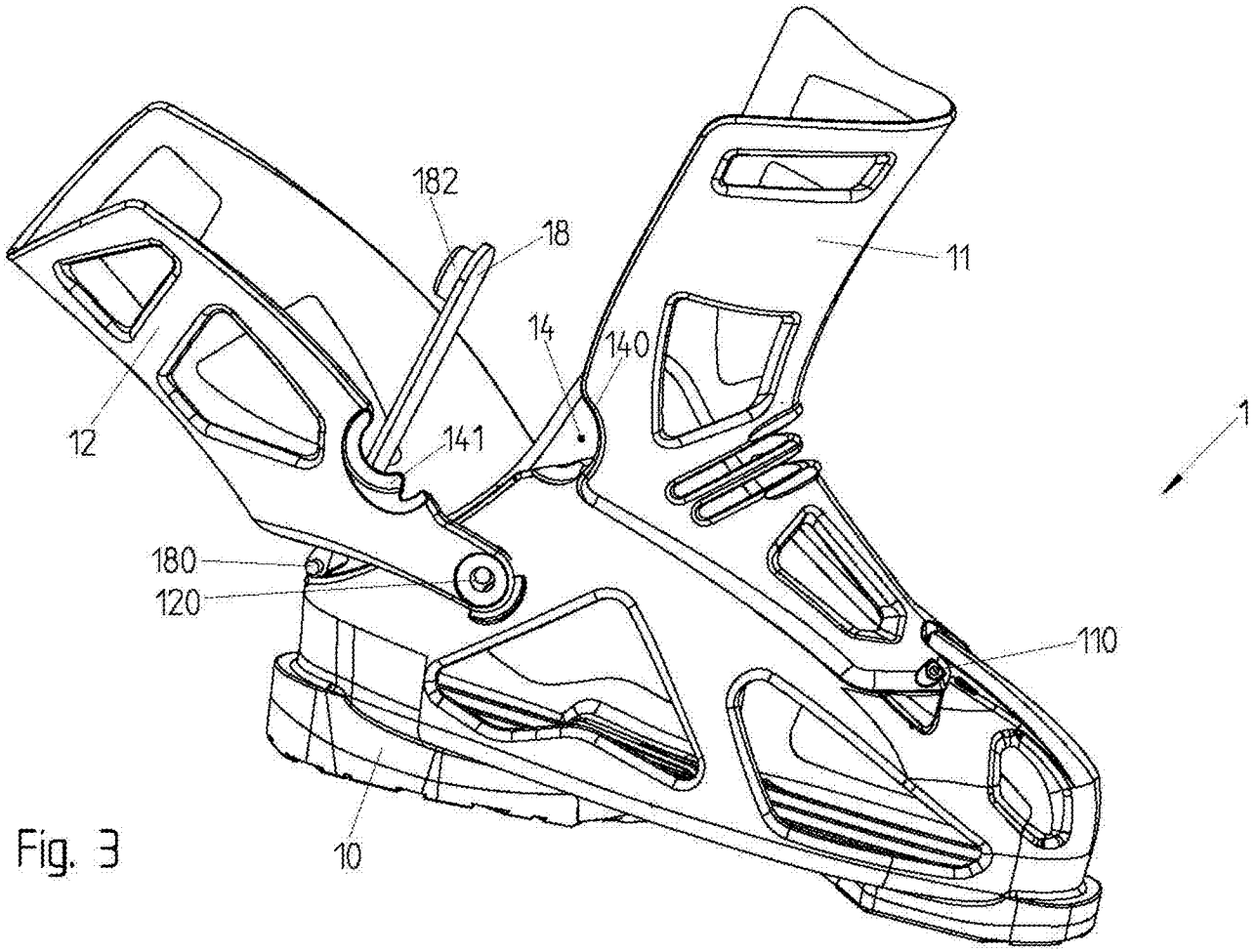
FIG. 3 illustrate an exogenous shell on its own with the rear part of the upper being open.
Figure 4:
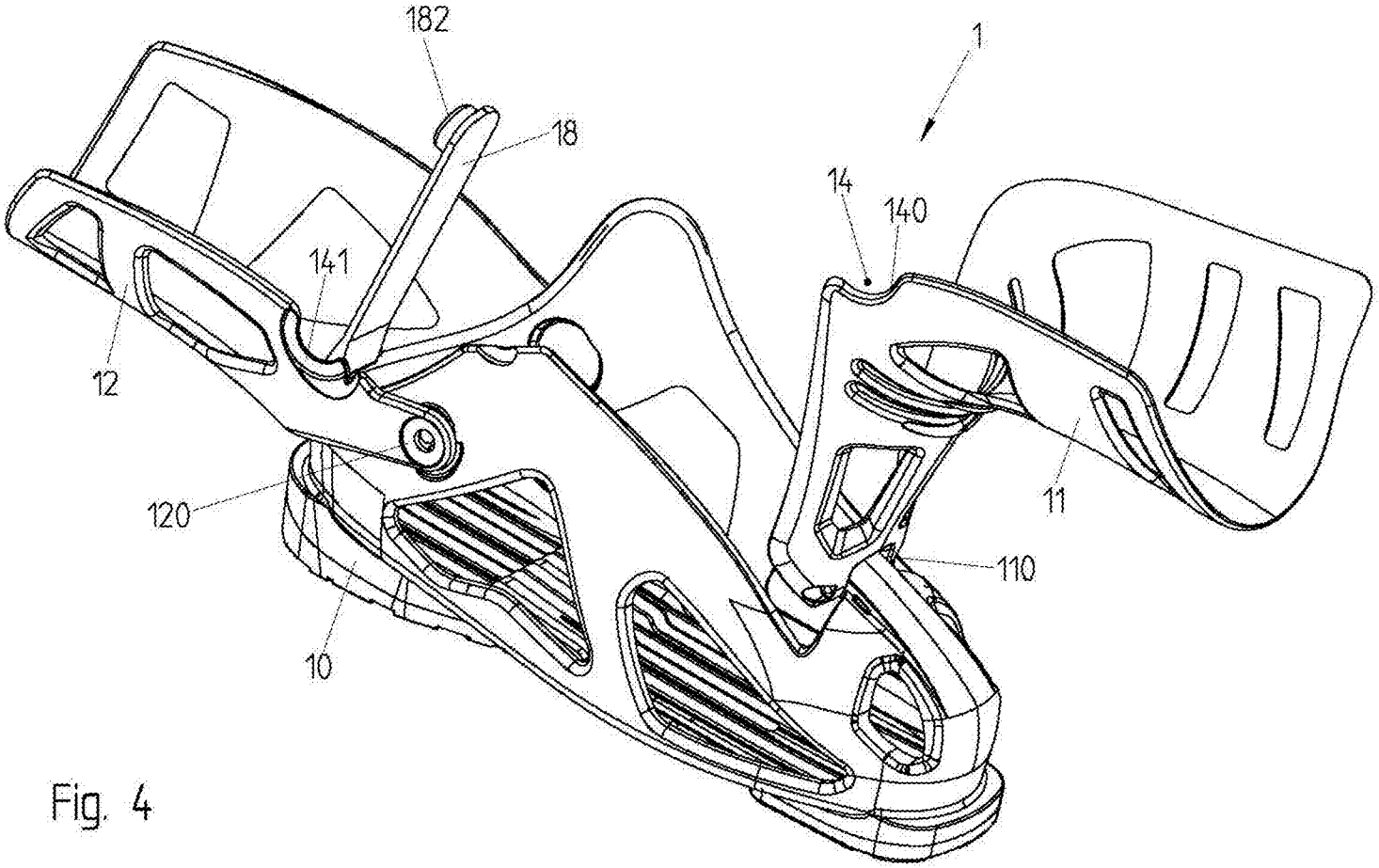
FIG. 4 illustrates an exogenous shell on its own with the rear part and the forward part of the upper being both open.
Figure 5:
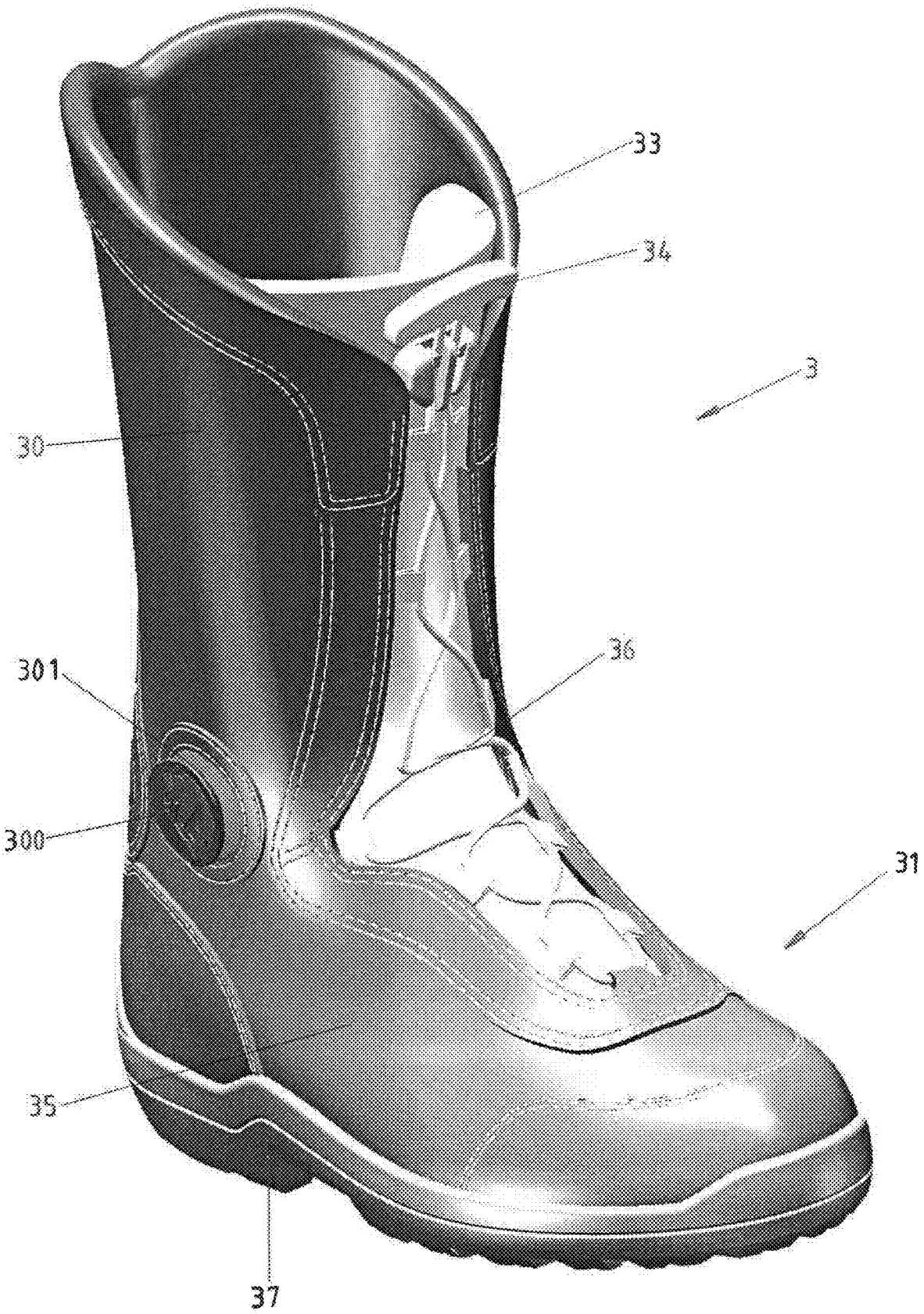
FIG. 5 illustrates an inner boot on its own, capable of working with the exogenous shell of the preceding figures.
Figure 6:
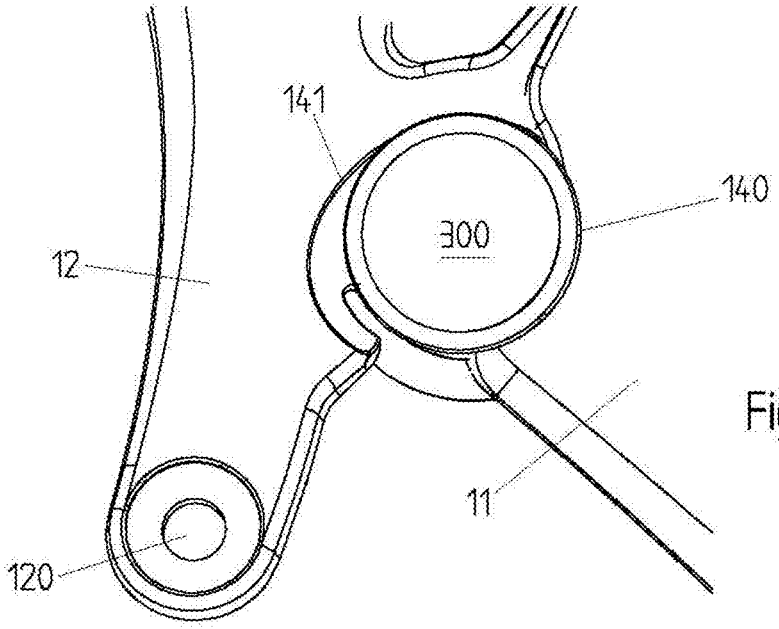
FIGS. 6 and 7 illustrate different views of a detail of the fastening of the inner boot to the exogenous shell.
Figure 7:
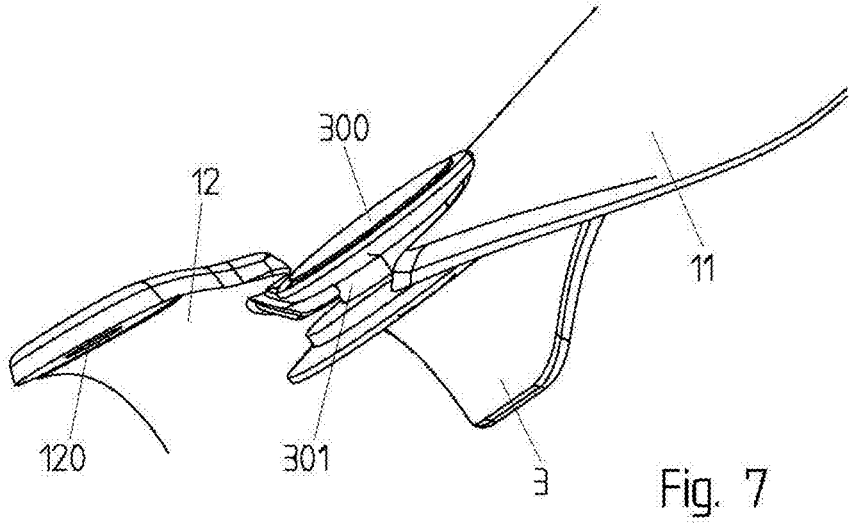

The sports boot illustrated in FIG. 1 comprises an inner boot 3, illustrated in more detail in FIG. 5, and an exogenous shell 1 illustrated in FIGS. 2 to 4. The inner boot 3 is designed to keep the foot warm and to make it possible to walk comfortably in town, at the ski restaurant or in the snow. The exogenous shell 1 is designed to rigidify this inner boot and to enable it to be introduced into a ski binding or into another piece of sports equipment. The foot and the ankle are held by the inner boot, which is provided for example with laces, and with a greater pressure by the exogenous shell when the latter is closed.

The inner boot 3 comprises different soft padding materials 35 ensuring thermal insulation, waterproofing and comfort. The sole of the inner boot and the reinforcing rings above the base and/or the upper can however be made of rigid synthetic materials. The inner boot is however not entirely protected by the exogenous shell 1 and must therefore be made of waterproof materials. For example, the inner boot can be made of leather, Goretex, nylon etc. with soft padding of synthetic or natural materials.

The external shell 1 is itself made of rigid synthetic material. It has a structure that is to a large extent perforated to make it lighter and to allow the inner boot to be seen.

The dimensions of the exogenous shell enable the inner boot to be inserted into or extracted from it. As is seen in FIG. 2, it comprises a sole 10, a forward part 11 of an upper capable of pivoting with respect to said sole 10 around a first articulation 110 and a rear part 12 of an upper capable of pivoting with respect to said sole 10 around a second articulation 120. In a variant embodiment, not illustrated, it is also possible for only one of the two parts of the upper to be articulated. The inner boot can be inserted into the exogenous shell respectively extracted by pivoting the forward part 11 and/or the rear part 12 of the upper, as seen in FIGS. 3 and 4. In one embodiment, the inner boot could however be extracted or inserted by pivoting only the rear part 12, with the forward part remaining in the position illustrated in FIG. 3; however, the pivoting of the forward part makes the extraction easier and further enables the height and space requirement of the exoskeleton to be reduced if it remains on the ski. Reference number 18 illustrates a reinforcement around the Achilles tendon pivoting around an axis 180 connected with the basis of the exogenous shell and which, in closed position, is fastened against the inner side of the rear part 12 of the upper by means of a tenon 182 inserted in an opening of this rear upper.

The exogenous shell 1 can be closed and tightened by means of shoe buckles, in this example two buckles 112, 113 that make it possible to tense cables holding the forward part 11 of the upper tight against the rear part 12 of the upper.

The inner boot illustrated in FIG. 5 comprises a base 31, an upper 30 and a sole 37. Reference 35 indicates padding. It is closed by means of a lace 36 with a lace-stopper 34 that enables the lace to be tensed and the lace-stopper 34 to be hooked onto a fixed point on the tongue 33.

The inner boot 3 further comprises a pivot 300 on the outer side of the ankle that enables it to be fastened to the exogenous shell. A similar pivot could also be provided on the inner side of the ankle but during use proves a hindrance for walking, so that for many types of boot it is preferable to omit it.

The exogenous shell comprises a housing 14 on the inner side of the ankle in order to accommodate this pivot. The housing is constituted by an indentation 140 in a semi-circle on the forward part 11 of the upper and of a similar indentation 141 on the rear part 12 of the upper, that come to slide in a groove 301 in the pivot 300. The housing 14 can thus be opened respectively closed by pivoting the forward part 11 of the upper and/or the rear part 12 of the upper of the exogenous shell. The pivot 300 thus constitutes a rigid fastening point between the inner boot 3 and the exogenous shell 1, capable of transmitting the forces efficiently between these two parts of the boot.

In a variant embodiment, not represented, the base 31 of the inner boot is articulated relative to the upper 30 of this inner boot around the two pivots, so as to allow a limited flexion of the upper.

Figure 8:
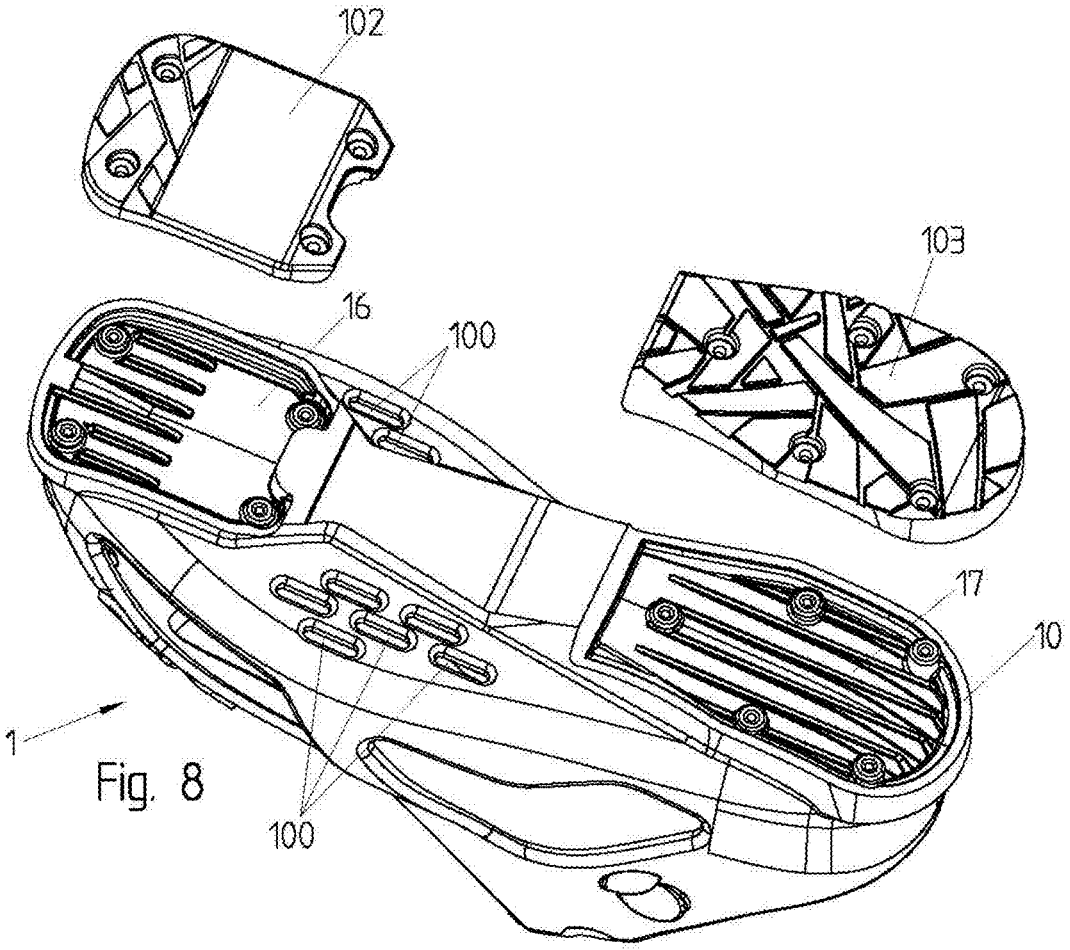
FIG. 8 illustrates a view from below of the sole of the exogenous shell.
Figure 9:
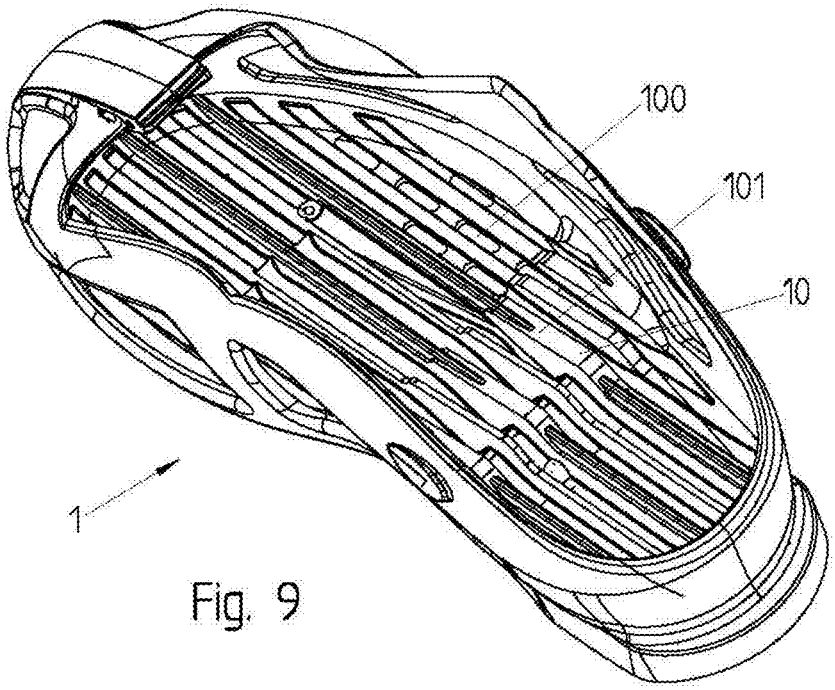
FIG. 9 illustrates a view from above of the sole of the exogenous shell.

FIGS. 8 and 9 illustrate two views of the sole 10 of the exogenous shell 1. As is seen in FIG. 8, the sole 10 comprises a front plate 102 and a rear plate 103 that constitute replaceable wear parts fastened under the sole. Holes 100 through the sole 10 allow water and snow that accumulates inside the exogenous shell to be evacuated.

The inner side of the sole 10 is provided with a relief pattern constituted here by ribs 101 separated by grooves and collaborating with corresponding grooves and ribs under the sole 37 of the inner boot, in order to ensure an accurate lateral positioning of the inner boot 3 in the exogenous shell 1 and a transmission of forces between these two parts of the boot. This construction further makes it possible to ensure a constant positioning of the inner boot in the exogenous shell, even if the sole 37 becomes worn when used for walking; indeed, the bottom of the grooves under the sole 37 is unlikely to become worn, so that the vertical position of the inner boot remains unchanged even if the ribs of the sole 37 become worn.

The exogenous shell advantageously comprises a structure that is to a large extent perforated to allow the inner boot to be seen. In one embodiment, the sole of the exogenous shell is comprised of two parts that are welded, glued or mechanically assembled to one another; by varying the longitudinal fastening position, it is possible to produce soles of different shoe sizes from a single mold.

REFERENCE NUMBERS USED IN THE FIGURES

1 exogenous shell
10 sole
100 holes in the sole
101 longitudinal ribs on the inner side of the sole
102 toe plate
103 heel plate
11 forward part of the upper
110 pivoting point of the forward part of the upper
112-113 buckles
114-115 tightening cables
12 rear part of the upper
120 pivoting point of the rear part of the upper
14 housing for pivot
140 front of the housing for the pivot
141 rear of the housing for the pivot
16 front of the sole
17 rear of the sole
18 reinforcement around the Achilles tendon
180 axis of the reinforcement around the Achilles tendon
181 lock for reinforcement around the Achilles tendon
3 inner boot
30 upper of the inner boot
300 pivot on the upper of the inner boot
301 groove
31 base of the inner boot
33 tongue
34 lace-stopper
35 padding
36 laces
37 sole of the inner boot

The invention claimed is:

1. Sports boot comprising:

an inner boot;

an exogenous shell, whose dimensions allow said inner boot to be inserted into or extracted from it, said exogenous shell strengthening said inner boot and allowing it to be attached to a piece of sports equipment;

said exogenous shell comprising a sole and an upper;

the upper having a forward part and a separate rear part;

said inner boot having an attached pivot protruding on an outer side close to an ankle, said exogenous shell comprising a housing for accommodating the pivot, wherein one portion of a circumference of said housing is an indentation formed on the forward part of the upper, and another portion of the circumference of this housing is an indentation formed on the rear part of the upper;

wherein both the indentation on the forward part of the upper and the indentation on the rear part of the upper form a closed housing for lodging the pivot therein; and wherein said housing can be opened and respectively closed by pivoting said forward part of the upper or said rear part of the upper.

2. Sports boot according to claim 1, wherein said pivot comprises an annular groove for accommodating said indentations.

3. Sports boot according to claim 1, wherein said exogenous shell comprises a forward part of an upper capable of pivoting with respect to the sole around a first articulation and/or a rear part of an upper capable of pivoting with respect to said sole around a second articulation.

4. Sports boot according to claim 3, wherein inner boot can be inserted into the exogenous shell and respectively extracted from the exogenous shell by pivoting said rear part of the upper.

5. Sports boot according to claim 3, comprising buckles for holding said forward part of the upper and said rear part of the upper closed and tight one against the other.

6. Sports boot according to claim 1, including a reinforcement provided to an interior surface of the exogenous shell and configured to be located adjacent to an Achilles tendon that is articulated relative to the sole of the exogenous shell and that can be fastened to the rear part of the upper.

7. Sports boot according to claim 1, wherein said sole comprises holes for evacuating water.

8. Sports boot according to claim 1, wherein said sole comprises a relief pattern, the inner boot comprising a sole with a corresponding relief pattern, so as to position laterally and vertically said inner boot in the exogenous shell.

9. Sports boot according to claim 1, wherein the inner boot comprises a lace.

10. Sports boot according to claim 9, comprising a lace-stopper that enables the lace to be tensed by fastening said stopper onto a fixed point.

11. Sports boot comprising:

an inner boot;

an exogenous shell, whose dimensions allow said inner boot to be inserted into or extracted from it, said exogenous shell strengthening said inner boot and allowing it to be attached to a piece of sports equipment;

said exogenous shell comprising a sole and an upper;

the upper having a forward part and a separate rear part;

said inner boot having an attached pivot protruding on an outer side close to an ankle, said exogenous shell comprising a housing for accommodating the pivot, wherein one portion of the circumference of said housing is an indentation formed on the forward part of the upper, and another portion of the circumference of this housing is an indentation formed on the rear part of the upper, wherein both the indentation on the forward part of the upper and the indentation on the rear part of the upper form a closed housing for lodging the pivot therein, and wherein said housing can be opened and respectively closed by pivoting said forward part of the upper or said rear part of the upper, wherein said sole comprises a continuous inner relief pattern constituted by ribs separated by grooves extending longitudinally along an entire length of the sole, the inner boot comprising a sole with a corresponding relief pattern, so as to position laterally and vertically said inner boot in the exogenous shell.

12. Sports boot comprising:

an inner boot;

an exogenous shell, whose dimensions allow said inner boot to be inserted into or extracted from it, said exogenous shell strengthening said inner boot and allowing it to be attached to a piece of sports equipment;

said exogenous shell comprising a sole and an upper;

wherein said upper comprises a forward part and a separate rear part;

said inner boot having an attached pivot protruding on an outer side close to an ankle, said exogenous shell comprising a housing for accommodating the pivot, wherein one portion of a circumference of said housing is an indentation formed on the forward part of the upper, and another portion of the circumference of this housing is an indentation formed on the rear part of the upper, wherein both the indentation on the forward part of the upper and the indentation on the rear part of the upper form a closed housing for lodging the pivot therein; and wherein said housing can be opened and respectively closed by pivoting said forward part of the upper or said rear part of the upper;

wherein said rear part of the upper comprises an interior surface facing into the exogenous shell; and said sports boot further including a reinforcement part provided to the interior surface of the rear part of the upper and located adjacent to an Achilles tendon that is articulated relative to the sole of the exogenous shell and that can be fastened to the rear part of the upper.

13. Sports boot comprising:

an inner boot;

an exogenous shell, whose dimensions allow said inner boot to be inserted into or extracted from it, said exogenous shell strengthening said inner boot and allowing it to be attached to a piece of sports equipment;

said exogenous shell comprising a sole and an upper;

wherein said upper comprises a forward part and a rear part;

wherein said rear part of the upper comprises an interior surface facing into the exogenous shell, wherein said rear part is articulated on a first axis that is fixed and stationary relative to the sole; and said sports boot further including a reinforcement part provided to the interior surface of the rear part of the upper and configured to be located adjacent to an Achilles tendon, wherein said reinforcement part is articulated on a second axis that is fixed and stationary relative to the sole of the exogenous shell and that can be fastened to the rear part of the upper, and wherein said reinforcement part is separately articulated with reference to the rear part of the upper.

14. Sports boot comprising:

an inner boot;

an exogenous shell, whose dimensions allow said inner boot to be inserted into or extracted from it, said exogenous shell strengthening said inner boot and allowing it to be attached to a piece of sports equipment;

said exogenous shell comprising a sole and an upper;

wherein said upper comprises a forward part and a rear part;

wherein said rear part of the upper comprises an interior surface facing into the exogenous shell, wherein said rear part is articulated on an axis that is fixed and stationary relative to the sole;

wherein said sole comprises a continuous inner relief pattern constituted by longitudinally-extending ribs separated by longitudinally-extending grooves extending continuously along an entire length of the sole, the inner boot comprising a sole with a corresponding relief pattern, so as to position laterally and vertically said inner boot in the exogenous shell, said sports boot further including a reinforcement part provided to the interior surface of the rear part of the upper and configured to be located adjacent to an Achilles tendon, wherein said reinforcement part is articulated relative to the sole of the exogenous shell and that can be fastened to the rear part of the upper, and wherein said reinforcement part is separately articulated with reference to the rear part of the upper.

15. The sports boot according to claim 1, further comprising buckles for holding said forward part of the upper and said rear part of the upper closed and tight one against the other.

16. The sports boot according to claim 1, wherein an inner side of said sole is ribbed.

17. The sports boot according to claim 1, further comprising a ribbed sole.

18. The sports boot according to claim 12, wherein said rear part is articulated relative to the sole, and wherein said reinforcement part is separately articulated with reference the rear part of the upper.

19. The sports boot according to claim 13, wherein said forward part is articulated relative to the sole and wherein said reinforcement part is separately articulated with reference to the forward part of the upper.

20. The sports boot according to claim 14, wherein said forward part is articulated relative to the sole and wherein said reinforcement part is separately articulated with reference to the forward part of the upper.

21. The sports boot according to claim 12, wherein said forward part is articulated relative to the sole, and wherein said reinforcement part is separately articulated with reference to the forward part of the upper.

22. The sports boot according to claim 13, wherein the rear part is behind the inner boot.

23. Sports boot comprising:

an inner boot;

an exogenous shell, whose dimensions allow said inner boot to be inserted into or extracted from the exogenous shell, said exogenous shell strengthening said inner boot and allowing said inner boot to be attached to a piece of sports equipment;

said exogenous shell comprising a sole and an upper, wherein said upper comprises a forward part and a rear part, wherein said rear part of the upper comprises an interior surface facing into the exogenous shell, wherein an opening is formed at the interior surface of the rear part, and wherein said rear part is articulated on a first axis that is fixed and stationary relative to the sole; and a reinforcement part provided to the interior surface of the rear part of the upper and configured to be located adjacent to an Achilles tendon, wherein said reinforcement part is articulated on a second axis that is fixed and stationary relative to the sole of the exogenous shell separately from the rear part of the upper, wherein the reinforcement part includes a tenon configured to be removably inserted into the opening such that when the exogenous shell is in a closed position, the tenon is inserted into the opening in order to fasten the reinforcement part to the rear part of the upper.

* * * * *